United States Patent [19]

Schattmaier

[11] 4,061,304

[45] Dec. 6, 1977

[54] SURGICAL CHAIR FOR A DOCTOR

[75] Inventor: Kurt Schattmaier, Zurich, Switzerland

[73] Assignee: Contraves AG, Zurich, Switzerland

[21] Appl. No.: 717,657

[22] Filed: Aug. 25, 1976

[30] Foreign Application Priority Data

Sept. 30, 1975 Switzerland ..... 12634/75

[51] Int. Cl.[2] ..... F16M 11/00

[52] U.S. Cl. ..... 248/404; 248/188.7; 248/188.91; 403/388

[58] Field of Search ..... 248/400, 161, 162, 418, 248/157, 159, 188.7, 158, 401, 404, 188.91; 297/347; 403/53, 55, 63, 108, 388; 74/522, 560, 562, 562.5

[56] References Cited

U.S. PATENT DOCUMENTS

| | | | |
|---|---|---|---|
| 566,979 | 9/1896 | Geise | 248/188.91 |
| 1,255,220 | 2/1918 | Petry | 74/522 |
| 1,526,999 | 2/1925 | Mizner et al. | 74/562 |
| 1,670,561 | 5/1928 | Adams | 248/188.91 |
| 2,231,631 | 2/1941 | Malna | 248/161 |
| 2,609,862 | 9/1952 | Pratt | 297/347 |
| 2,658,411 | 11/1953 | Eversman | 74/562.5 |
| 2,706,653 | 4/1955 | Blakely | 403/53 |
| 3,147,946 | 9/1964 | Hale | 297/347 |
| 3,381,926 | 5/1968 | Fritz et al. | 248/404 |

FOREIGN PATENT DOCUMENTS

| | | | |
|---|---|---|---|
| 426,360 | 3/1926 | Germany | 248/161 |
| 924,721 | 3/1955 | Germany | 248/161 |
| 2,225,999 | 12/1973 | Germany | 403/388 |
| 322,511 | 6/1957 | Switzerland | 248/188.7 |
| 423,131 | 4/1967 | Switzerland | 248/404 |
| 700,411 | 12/1953 | United Kingdom | 248/161 |

*Primary Examiner*—Marion Parsons, Jr.
*Attorney, Agent, or Firm*—Werner W. Kleeman

[57] ABSTRACT

A surgical chair for a doctor embodying an infinitely elevationally adjustable seat connected with a support column, a stand tube arranged within the support column, at which there is attached a base frame equipped with rollers and a lifting device within the stand tube. The lifting device is operatively connected with the support column and can be unblocked by a lever system so that the seat, depending upon the degree of loading thereof, is elevationally adjustable. A foot pedal located between two overhang members of the base frame is arranged with its upper edge at most 4 centimeters above the floor and with adjustable freedom of movement with respect to the floor. The foot pedal is secured by a lever to an angle lever pivotably mounted at the stand tube and acts upon a plunger of the lifting device. At least three guide grooves are provided at the support column and extend uniformly about its inner periphery and parallel to its central axis. At least two superimposed sets of spaced rollers are secured at the outer periphery of the stand tube in operable association with the guide grooves arranged at the support column.

5 Claims, 3 Drawing Figures

SURGICAL CHAIR FOR A DOCTOR

BACKGROUND OF THE INVENTION

The present invention relates to a new and improved construction of surgical chair for a doctor or treating physician. The term "doctor" is used herein in its broader sense as relating to individuals with various type of medical training.

A rotatable chair for a doctor has been disclosed in German Pat. No. 1,900,949 wherein a ring-shaped foot-operated switching plate is arranged above a base or foot frame formed of individual cantilever or overhang members. The switching plate, through the agency of a switching plunger and a tiltable lever of a valve, activates a gas spring or cushion and thus renders possible infinite elevational adjustment of the seat. In order to ensure for such elevational adjustment of the seat, depending upon the degree of loading or unloading thereof, during treatment by the physician, it is necessary with this rotatable chair that the doctor lift his body weight with one foot and with his other foot operate the switching plate. It will be evident that such requires undesired shifting of the weight of the body as well as one-sided loading of the body, which does not guarantee either the necessary secure and steady standing of the rotatable chair upon the floor or the required firm standing of the doctor, and thus, restricts to an unwarranted extent the activity of the treating physician.

A combined surgical chair having a pivotable work chair for the treating physician is taught in German Pat. No. 1,110,818 wherein there is provided a pivotable arm having a holding device for a foot pedal switch for regulating, for instance, a drilling machine used by a dentist at the neighborhood of the surgical chair. The pivotable arm, for instance of resilient construction, adjustable to a certain braking action, and arranged with the foot rest flat above the floor is designed such that when it is loaded by the weight of the foot of the doctor the load is taken up by the floor, and hence, when necessary, the work chair or seat can be rocked without difficulty out of the working region and the foot pedal switch remains as previously in its predetermined position.

SUMMARY OF THE INVENTION

Starting with the aforementioned state-of-the-art it is a primary object of the present invention to provide a stable surgical chair wherein, while maintaining contact with the floor with both feet and without any assistance from the hands of the operator, there is possible a continuous elevational adjustment of a seat secured to a support column by means of a pedal actuated by the heel of one foot, and further, a support column which telescopically engages over a stand tube is guided centrally and axially displaceable at the stand tube without canting and at the same time is positively secured against rotation to the stand tube and wherein, the foot or base frame consisting of a number of cantilevers or overhang arms and secured to the stand tube has a relatively small reach or overhang.

Still a further significant object of the present invention aims at the provision of a new and improved construction of surgical chair which is relatively simple in construction and design, economical to manufacture, extremely reliable in operation, and allows for easy elevational adjustment of the seat by the user.

Now in order to implement these and still further objects of the invention, the surgical chair for a treating physician or the like as contemplated by the invention comprises a seat infinitely adjustable in elevation and secured to a support column. A stand tube is arranged within the support column and a foot or base frame provided with rollers is secured to the stand tube. A lifting device is arranged within the stand tube and is operatively connected with the support column and can be unlocked or activated by means of a lever system, so that the seat, depending upon loading thereof, is elevationally adjustable. According to important aspects of the invention the surgical chair is manifested by the following combination of features:

a. a foot pedal is arranged symmetrically between two cantilevers or overhang members of the base frame with adjustable elevational spacing from the floor and has its upper edge at most four centimeters above the floor, the foot pedal is operatively connected by a lever with an angle lever pivotably mounted at the stand tube and acting upon a plunger of the lifting device;

b. at least three guide grooves are provided at the support column and extend substantially parallel to the central axis thereof and are uniformly distributed about its inner periphery; and c. at least two superimposed mutually spaced rollers or roller means are arranged at the outer periphery of the stand tube in operative association with the guide grooves provided at the support column.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
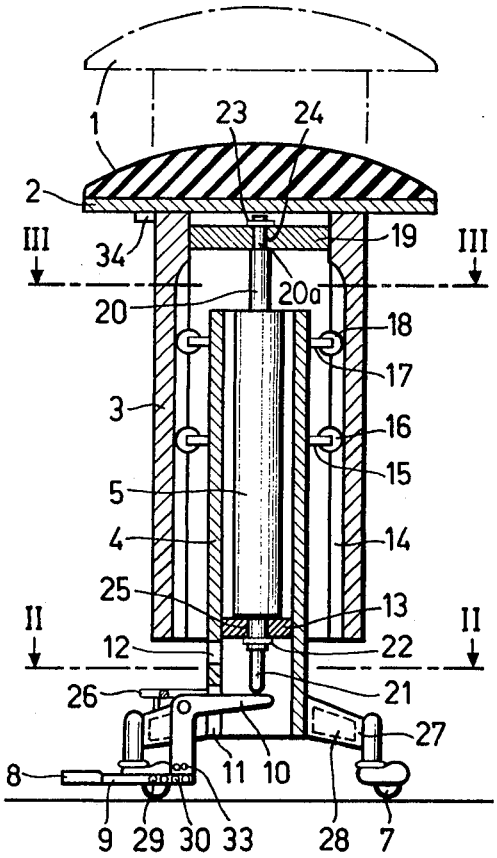
FIG. 1 illustrates in longitudinal sectional view the essential components of an elevationally adjustable surgical chair together with the schematically illustrated lifting device.

Describing now the drawings, there is shown in FIG. 1, in longitudinal sectional view, an exemplary embodiment of a surgical chair having an infinitely elevationally adjustable seat 1, a support column 3, a stand or vertical tube 4 arranged within the support column 3 and at which there is secured the base or floor frame 6, and a lifting device 5 arranged within the stand tube or pipe 4.

At the lower side the lifting device 5, which is equipped at such side with a plunger 21, bears upon a disc or plate 13 having a bore 25. This plate 13 is arranged in the stand tube 4 and is retained by a securing ring 22 engaging about the shoulder of the lifting device 5 guided through the bore 25. In order to facilitate assembly of the securing ring 22 an opening 12 is provided at a suitable location in the wall of the stand tube or pipe 4. At the opposite upper side the lifting device 5 is provided with a piston rod 20 extending with its stepped end **20*a* through a suitably formed bore 24 of a disc or plate 19 arranged in the support column 3. The piston rod 20 is held by means of a securing ring 23 engaging about such stepped end 20a of the piston rod 20**.

At the outer periphery of the stand tube 4 there are rotatably mounted in any suitable and therefore not particularly illustrated manner at least three uniformly distributed rollers 18 and in spaced relation therefrom three further rollers 16 at the respective holder rings 17 and 15 attached to the stand tube 4.

Guide grooves 14 are provided for the rollers 16, 18. These guide grooves 14 are arranged in a distributed manner analogous to the distribution of the rollers 16, 18 and extend parallel to the central axis of the support column and are uniformly arranged at the inner periphery of the support column 3. Further such guide grooves 14 extend from the lower edge of the support column 3 up to approximately the plate or disc 19. In this way the seat 1 having a seat plate 2 and secured by not particularly illustrated means, e.g., fastening bolts or the like at the support column 3 provided with the spaced brackets 34, during up and down movement, is optimumly guided and at the same time secured against rotation. In FIG. 1 the rollers 16, 18 with the associated grooves 14 have been illustrated in an offset arrangement.

Figure 3:
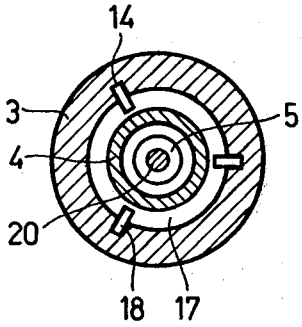
FIG. 3 is a cross-sectional view taken substantially along the line III—III of FIG. 1.

FIG. 3 is a sectional plan view and illustrates the support column 3 with the grooves 14, the stand or vertical tube 4 with the holder ring 17, the diameter of which is somewhat smaller than the inner diameter of the support column 3, the rollers or rolls 18 guided in the grooves 14, and the piston rod 20 of the lifting device 5.

Figure 2:
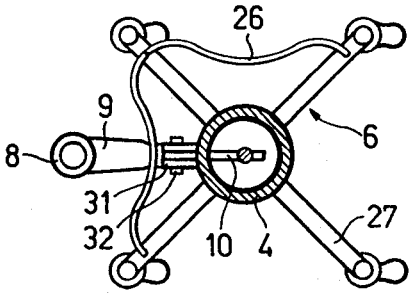
FIG. 2 is a plan view, taken in section along the line II—II of FIG. 1, of the base portion of the chair.

The base or floor frame 6 attached to the stand tube 4, in the illustrated embodiment, consists of four individual cantilevers or overhang arms 27 equipped with the travelling rollers or casters 7. These arms 27 have a relatively small overhang, and additionally, can be provided with balance or compensation weights 28 arranged in the overhang arms in order to impart still greater stability to the surgical chair. Above the overhang arms 27 there is provided at an appropriate elevation a foot rest 26 bearing upon the overhang arms, and which preferably is constructed and arranged in the manner shown in FIG. 2.

An angle lever 10 is mounted at a bolt 32 serving as an axis of rotation or pivot point. The angle lever 10 is symmetrically arranged between two cantilevers or overhang arms 27 at the lower end of the stand tube 4 between two bearing plates or members 31, for instance formed of sheet metal, secured to the stand tube 4. One end of the angle lever 10 extends through a slot 11 provided in the stand tube 4 up to the plunger 21 of the lifting device 5 and is operatively connected with, i.e., contacts such plunger. At the other end of the angle lever 10 there is secured at the lower portion thereof a foot lever 9 having a foot pedal 8.

The foot lever 9 together with its foot pedal 8 secured by the pin 30 or the like at the angle lever 10 can be variably adjusted in elevation with respect to the floor and also in spaced relation from the stand tube 4 due to the matched holes 29 and 33 provided at the foot lever 9 and the angle lever 10 and by selectively shifting the pin 30. The height of the upper edge of the foot pedal 8 from the floor at most amounts to 4 centimeters, but in any event is advantageously selected to be only so large that there is ensured that there can be carried out by the plunger 21 the stroke required for actuation of a not particularly illustrated control valve arranged in the lifting device 5.

The lifting device 5 is preferably in the form of a conventional gas spring or cushion having a control valve and a pre-biased filling medium, which, upon actuation of the valve, with the seat not loaded, infinitely elevationally displaces the same and when the seat is loaded moves down, and throughout the range of the stroke or displacement of the seat, in each desired position of the seat, the gas spring and thus the seat can be blocked.

According to a not particularly illustrated variant embodiment of the invention the possibility exists of providing a control device at the surgical chair which indicates the pressure of the pre-biased filling medium in the gas spring and at the same time indicates the functional reliability of the surgical chair.

The inventive surgical chair fulfills the requirements of random accommodation of the seat height to the momentary conditions with greatest operational reliability, and intentionally there has not been provided rotatability of the seat, in order to be able to undertake positioning of the foot-actuation pedal by means of the seat. Hence, the surgical chair can be delivered to the operator standing near the operating table and such can adjust the required seat height by either randomly using the left or right heel raised from the ankle joint, and without losing his balance.

While there are shown and described present preferred embodiments of the invention, it is to be distinctly understood that the invention is not limited thereto, but may be otherwise variously embodied and practiced within the scope of the following claims.

Accordingly, what is claimed is:

1. In a surgical chair for a treating physician, comprising an infinitely elevationally adjustable seat, a support column at which there is secured the seat, a stand tube arranged within the support column, a base frame having rollers connected with the stand tube, a lifting device arranged within the stand tube and operatively connected with the support column, a lever system for unblocking the lifting device, so that the seat, depending upon the load applied thereto, is elevationally adjustable, the improvement comprising:

a. the infinitely adjustable seat being non-rotatably mounted at the support column;
b. the base frame having a plurality of overhang arm members;
c. the lifting device having a plunger;
d. an angle lever pivotably mounted at the stand tube and acting upon said plunger;
e. a foot pedal having an upper edge;
f. means mounting the foot pedal with its upper edge at most 4 centimeters above the floor and symmetrically disposed between two overhang arm members of the base frame and with adjustable freedom of movement with respect to the floor;
g. a lever for connecting the foot pedal with the angle lever;
h. at least three guide grooves provided at the support column, said guide grooves being substantially uniformly distributed about the inner periphery of the support column and extending substantially parallel to the central axis of said support column;
i. at least three respective superimposed spaced rollers secured to the outer periphery of the stand tube and operatively associated with the guide grooves; and j. said surgical chair, during its normal position of use, having said foot pedal between the legs of the user, said non-rotatable seat safeguarding against undesirable shifting of the body of the user relative to the foot pedal, to thereby ensure that said foot pedal is maintained between the legs of the user, and wherein the user can carry out elevational adjustment of the non-rotatable seat at such time that the buttocks of the user are located directly over the seat of the surgical chair and with both legs of the user supported on the floor and with one leg actuating the foot pedal by the heel portion of such actuating leg through the ankle joint thereof.

2. The surgical chair as defined in claim 1, further including means for vertically and horizontally adjusting the foot pedal together with said lever connected with the angle lever.

3. The surgical chair as defined in claim 1, further including compensation weights provided for the overhang arm members of the base frame.

4. The surgical chair as defined in claim 1, further including a foot rest supported at the overhang arm members and arranged above the foot pedal between at least two of said overhang arm members.

5. In a surgical chair for a treating physician, comprising an infinitely elevationally adjustable seat, a support column at which there is secured the seat, a stand tube arranged within the support column, a base frame having rollers connected with the stand tube, a lifting device arranged within the stand tube and operatively connected with the support column, a lever system for unblocking the lifting device, so that the seat, depending upon the load applied thereto, is elevationally adjustable, the improvement comprising:

a. the infinitely adjustable seat being non-rotatably carried by the support column;

b. the base frame having a plurality of overhang arm members;

c. the lifting device having a plunger;

d. an angle lever pivotably mounted at the stand tube and acting upon said plunger;

e. a foot pedal having an upper edge;

f. means mounting the foot pedal with its upper edge at a predetermined spacing above the floor and symmetrically disposed between two overhang arm members of the base frame and with adjustable freedom of movement with respect to the floor;

g. a lever for connecting the foot pedal with the angle lever;

h. at least three guide grooves provided at the support column, said guide grooves being substantially uniformly distributed about the inner periphery of the support column and extending substantially parallel to the central axis of said support column;

i. at least three respective superimposed spaced rollers secured to the outer periphery of the stand tube and operatively associated with the guide grooves; and j. said surgical chair, during its normal position of use, having said foot pedal between the legs of the user, said non-rotatable seat safeguarding against undesirable shifting of the body of the user relative to the foot pedal, to thereby ensure that said foot pedal is maintained between the legs of the user, and wherein the user can carry out elevational adjustment of the non-rotatable seat at such time that the buttocks of the user are located directly over the seat of the surgical chair and with both legs of the user supported on the floor and with one leg actuating the foot pedal by the heel portion of such actuating leg through the ankle joint thereof.

* * * * *